US011289027B2

(12) United States Patent
Kim

(10) Patent No.: US 11,289,027 B2
(45) Date of Patent: Mar. 29, 2022

(54) LIGHT EMITTING DISPLAY DEVICE AND DRIVING METHOD THEREOF

(71) Applicant: LG Display Co., Ltd., Seoul (KR)

(72) Inventor: Hongsuk Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 255 days.

(21) Appl. No.: 16/559,347

(22) Filed: Sep. 3, 2019

(65) Prior Publication Data

US 2020/0074938 A1 Mar. 5, 2020

(30) Foreign Application Priority Data

Sep. 3, 2018 (KR) ..... 10-2018-0104557

(51) Int. Cl.
*G09G 3/32* (2016.01)
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2300/0452* (2013.01); *G09G 2310/08* (2013.01); *G09G 2330/12* (2013.01)

(58) Field of Classification Search
CPC .. G09G 3/3225; G09G 3/3233; G09G 3/3266; G09G 3/3275; G09G 3/3291; G09G 3/006; G09G 2300/0452; G09G 2310/08; G09G 2320/0295; G09G 2330/10; G09G 2330/12; G09G 2330/025; G09G 2330/08
See application file for complete search history.

(56) References Cited

U.S. PATENT DOCUMENTS

2002/0047565 A1* 4/2002 Nara ..... G09G 3/006 315/169.3
2007/0159742 A1* 7/2007 Iwabuchi ..... G09G 3/3225 361/54
2013/0050292 A1* 2/2013 Mizukoshi ..... G09G 3/3291 345/690
2013/0176194 A1* 7/2013 Jin ..... H01L 27/3276 345/76
2013/0307557 A1* 11/2013 Lee ..... G09G 3/006 324/522
2014/0084792 A1* 3/2014 Oh ..... G09G 3/3208 315/120
2014/0084941 A1* 3/2014 Yun ..... G09G 3/3225 324/543
2014/0329339 A1* 11/2014 Chaji ..... G01R 31/26 438/10
2015/0116302 A1* 4/2015 Kim ..... G09G 3/3225 345/212

(Continued)

FOREIGN PATENT DOCUMENTS

KR 10-2014-0052228 A 5/2014

*Primary Examiner* — Michael J Eurice
(74) *Attorney, Agent, or Firm* — Seed IP Law Group LLP

(57) ABSTRACT

A light emitting display device includes a display panel, a structure for short detection, and a short detecting unit. The display panel displays an image. The structure for short detection includes a first power line, a second power line, and a short detection line disposed between the first power line and the second power line in the display panel. The short detecting unit senses a sensing value from the short detection line and determines whether a short occurs in the display panel on the basis of the sensing value.

17 Claims, 20 Drawing Sheets

(56) References Cited

U.S. PATENT DOCUMENTS

| | | | | |
|---|---|---|---|---|
| 2016/0125811 | A1* | 5/2016 | Park | G09G 3/3258<br>345/694 |
| 2016/0225312 | A1* | 8/2016 | Byun | G09G 3/006 |
| 2016/0351095 | A1* | 12/2016 | Tani | G09G 3/3283 |
| 2017/0038427 | A1* | 2/2017 | Kim | H01L 27/3244 |
| 2020/0118492 | A1* | 4/2020 | Meng | G09G 3/3233 |
| 2020/0184867 | A1* | 6/2020 | Choi | G09G 3/3233 |

* cited by examiner

LIGHT EMITTING DISPLAY DEVICE AND DRIVING METHOD THEREOF

CROSS-REFERENCE TO RELATED APPLICATION(S)

This application claims the benefit of Korean Patent Application No. 10-2018-0104557, filed on Sep. 3, 2018, which is incorporated herein by reference for all purposes as if fully set forth herein.

BACKGROUND

Technical Field

The present disclosure relates to a light emitting display device and a driving method thereof.

Description of Related Art

With the development of information technology, the market of display devices as connection mediums between users and information, has grown. Accordingly, the use of display devices such as light emitting displays (LED), quantum dot displays (QDD), and liquid crystal displays (LCD) is on the increase.

The display devices described above include a display panel including subpixels, a driver for outputting a driving signal for driving the display panel, and a power supply unit for generating power to be supplied to the display panel or the driver.

When the driving signal, e.g., a scan signal, a data signal, or the like, is supplied to the subpixels formed on the display panel, the selected subpixels allow light to be transmitted therethrough or directly emit light to display an image.

Among the above-described display devices, the light emitting display has many advantages such as electrical and optical characteristics of high response speed, high brightness, and wide viewing angle and mechanical characteristics that may be realized in a flexible form.

BRIEF SUMMARY

In one aspect of the present disclosure, a light emitting display device including a display panel, a structure for short detection, and a short detecting unit is provided. The display panel displays an image. The structure for short detection includes a first power line, a second power line, and a line for short detection disposed between the first power line and the second power line in the display panel. The short detecting unit senses the line for short detection and determines whether a short occurs in the display panel on the basis of a sensing value.

In another aspect of the present disclosure, a method of driving a light emitting display device including a structure for short detection including a first power line, a second power line, a line for short detection disposed between the first power line and the second power line in a display panel, and a short detecting unit for sensing the line for short detection and determining whether a short occurs in the display panel on the basis of a sensing value is provided. The method of driving a light emitting display device includes: applying a voltage for short detection to the line for short detection; sensing the line for short detection to detect a sensing value; and determining whether a short occurs in the display panel on the basis of the sensing value.

BRIEF DESCRIPTION OF THE SEVERAL VIEWS OF THE DRAWINGS

The accompany drawings, which are included to provide a further understanding of the disclosure and are incorporated on and constitute a part of this specification illustrate embodiments of the disclosure and together with the description serve to explain the principles of the disclosure.

DESCRIPTION OF EMBODIMENTS

Hereinafter, embodiments of the present disclosure will be described with reference to the accompanying drawings.

The light emitting display device according to the present disclosure is implemented as a television, a video player, a personal computer (PC), a home theater, a smartphone, tablet PCs, wearable electronic watches, or the like. The light emitting display device described below performs an image display operation and an external compensation operation. The external compensation operation may be performed in units of subpixels or pixels.

The external compensation operation may be performed in a vertical blank period during the image display operation, in a power-on sequence period before image display starts, or in a power-off sequence period after image display ends. The vertical blank period, which is a period during which a data signal for image displaying is not written, is arranged between vertical active periods in which a data signal for one frame is written. The power-on sequence period refers to a period from when a power for driving the device is turned on to when an image is displayed. The power-off sequence period refers to a period from when image displaying is finished to when a power for driving the device is turned off.

In the external compensation method of performing the external compensation operation, a driving thin film transistor (hereinafter, driving transistor or driving TFT) is operated in a source follower manner and a voltage (e.g., source voltage of the driving TFT) stored in a line capacitor (e.g., parasitic capacitor) of a sensing line is sensed. In the external compensation method, a source voltage when a potential of a source node of the driving transistor is saturated (e.g., when a current Ids of the driving TFT becomes zero) to compensate for a threshold voltage deviation of the driving transistor. Also, in the external compensation method, a value of the source node of the driving transistor in a linear state before the source node reaches a saturation state is sensed in order to compensate for electron mobility deviation of the driving transistor.

Electrodes of a thin film transistor (TFT) described below includes a source electrode, a gate electrode, and a drain electrode. However, the drain electrode and the source electrode may differ for a transistor depending on the type of the transistor used. Thus, the electrodes besides the gate electrode will be described either as a first electrode or a second electrode to indicate either a source electrode or a drain electrode.

Figure 1:
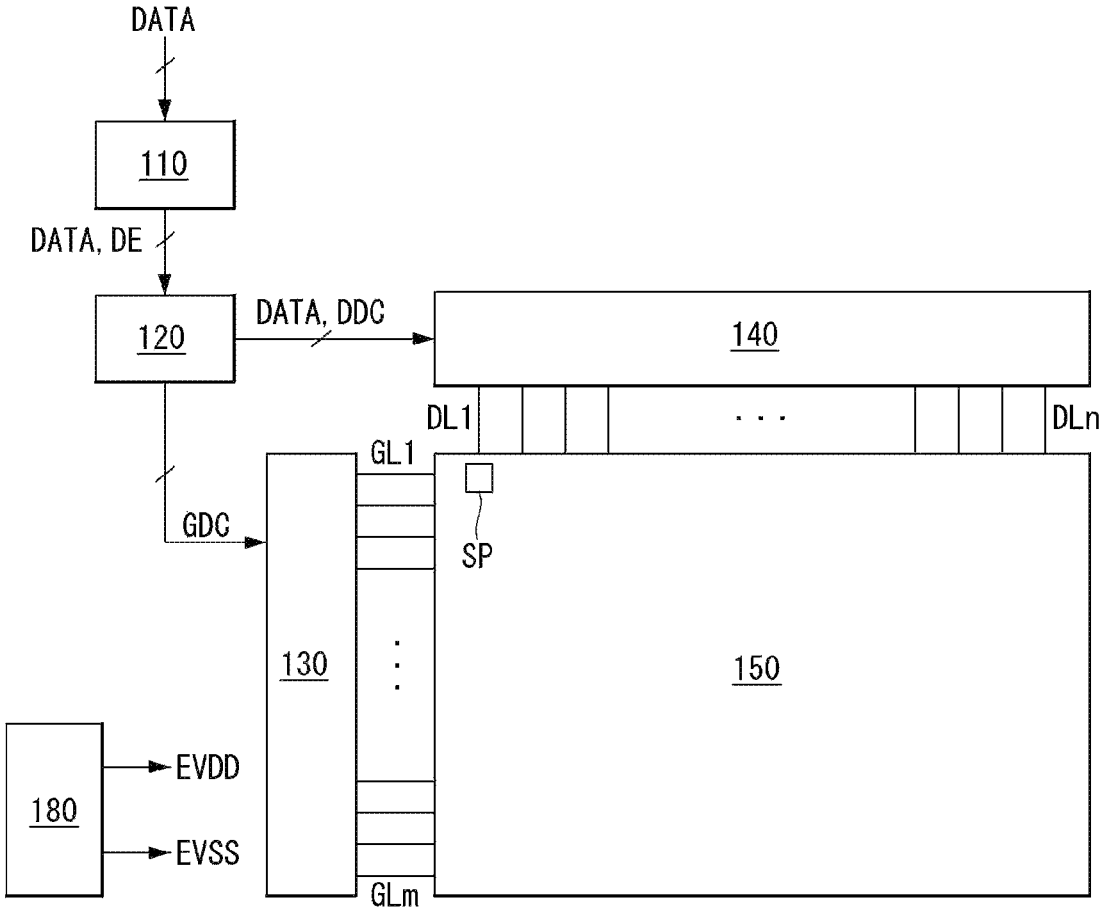
FIG. 1 is a schematic block diagram of a light emitting display device.
Figure 2:
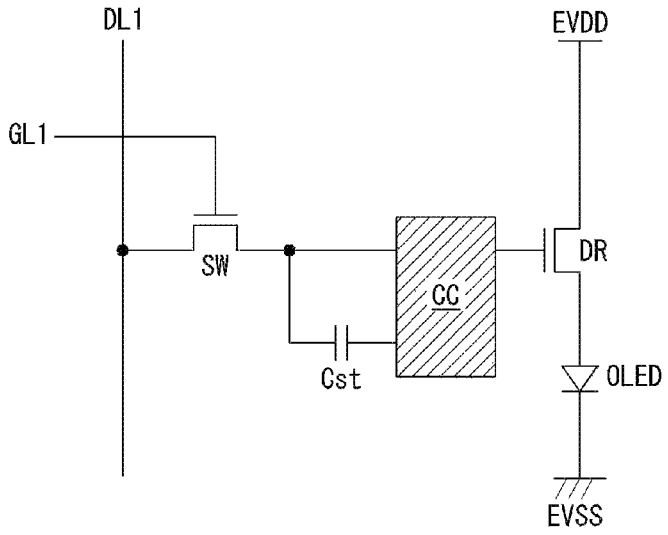
FIG. 2 is a schematic circuit diagram of a subpixel.
Figure 3:
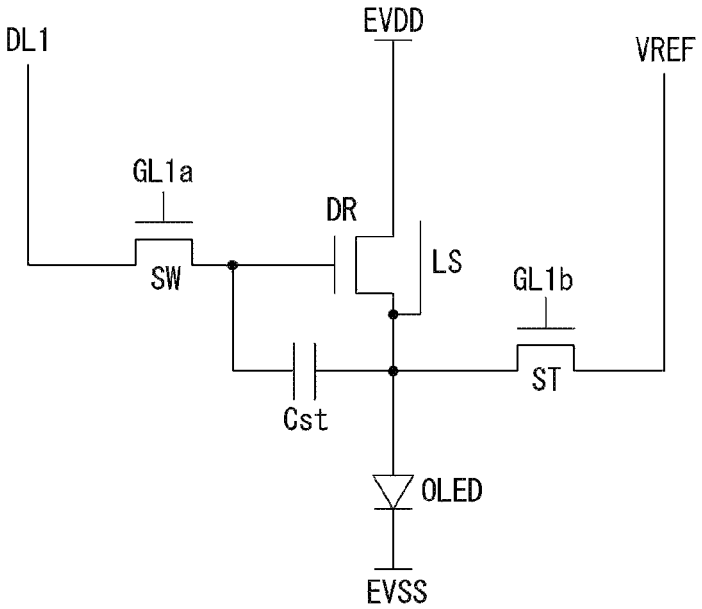
FIG. 3 is a view illustrating a specific circuit configuration of a subpixel.
Figure 4:
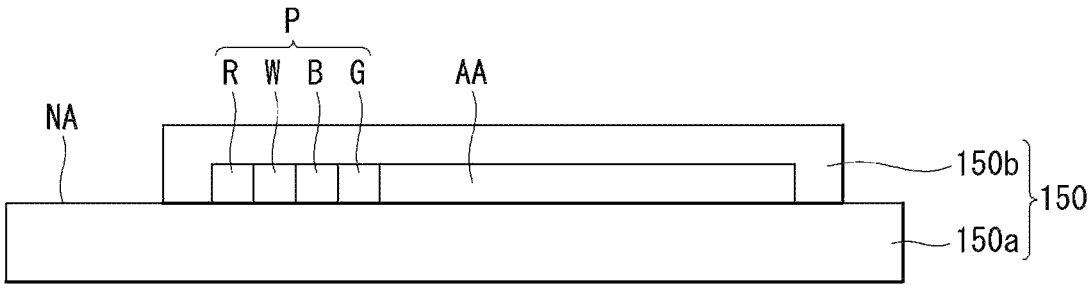
FIG. 4 is a cross-sectional view of a display panel.
Figure 5:
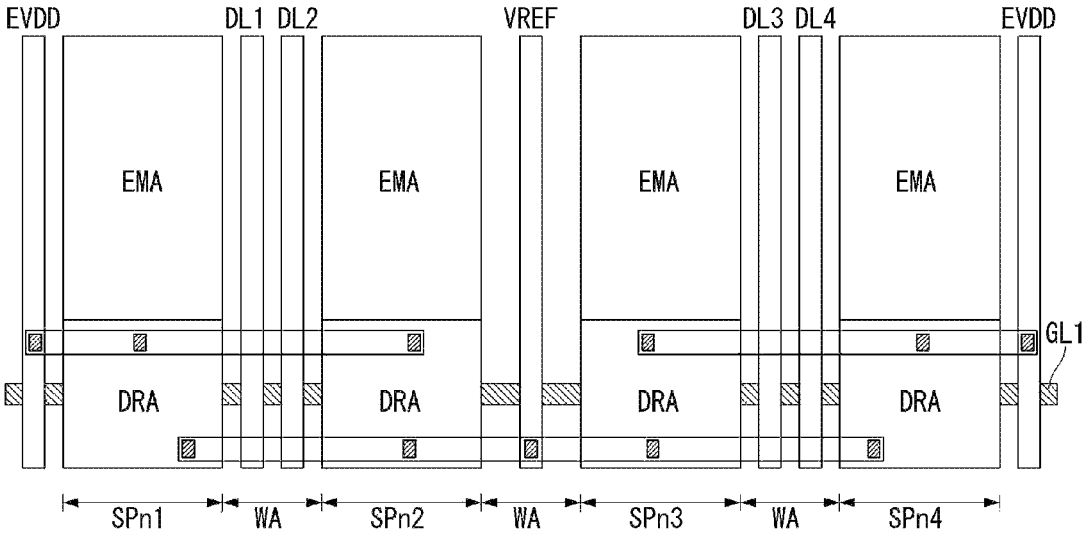
FIG. 5 is a plan view of a subpixel.
Figure 6:
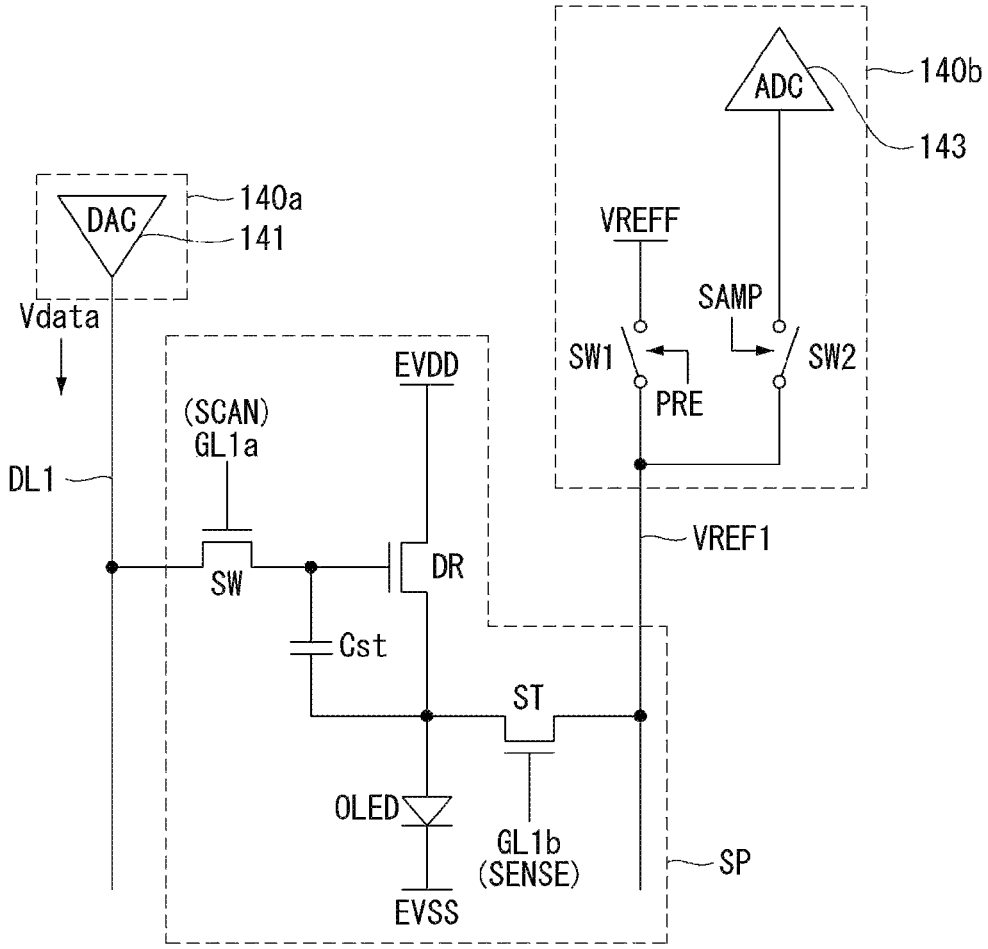
FIG. 6 is a schematic block diagram of a data driver including an external compensation circuit.
Figure 7:
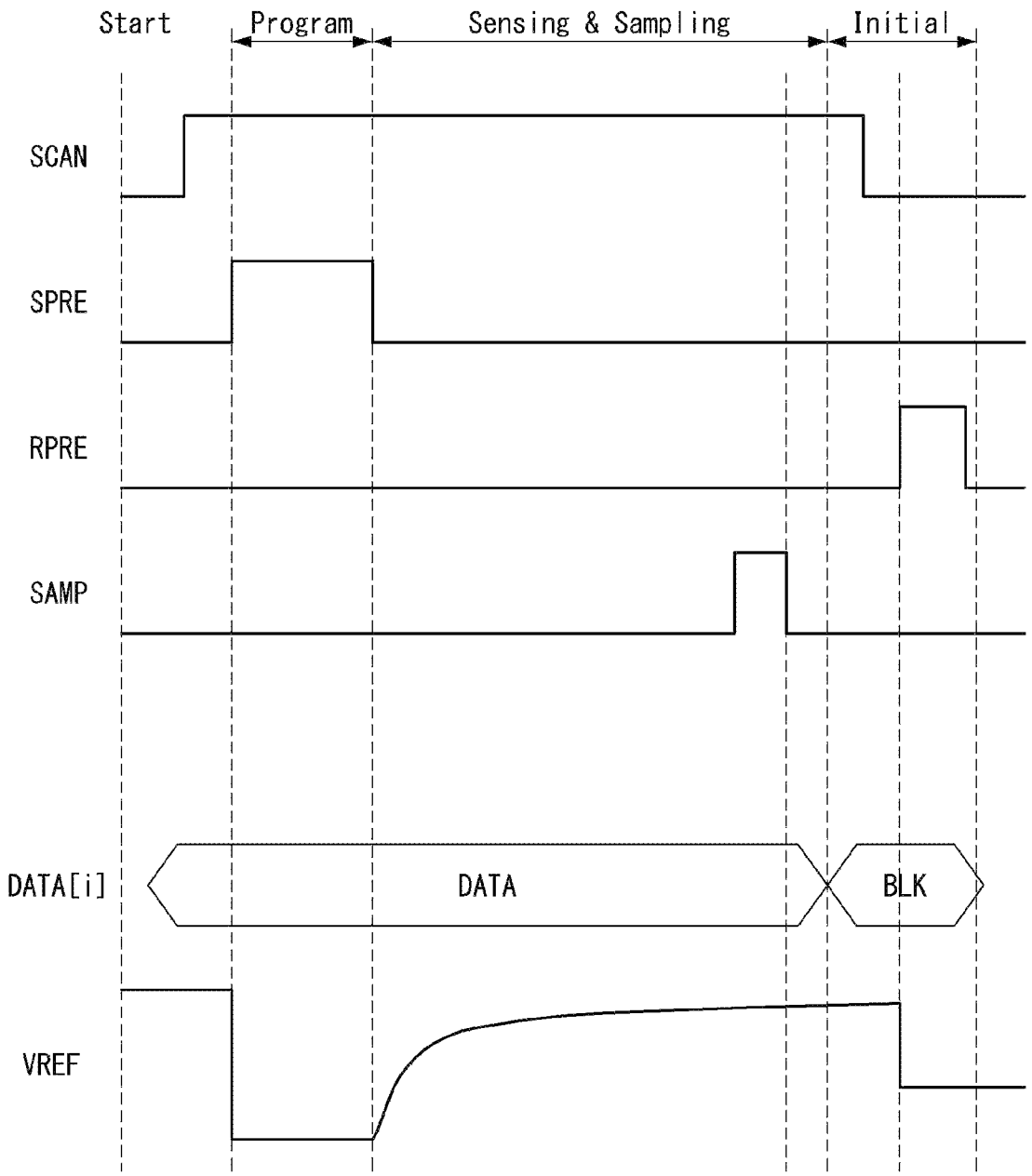
FIGS. 7 and 8 are waveform views for an external compensation operation.
Figure 8:
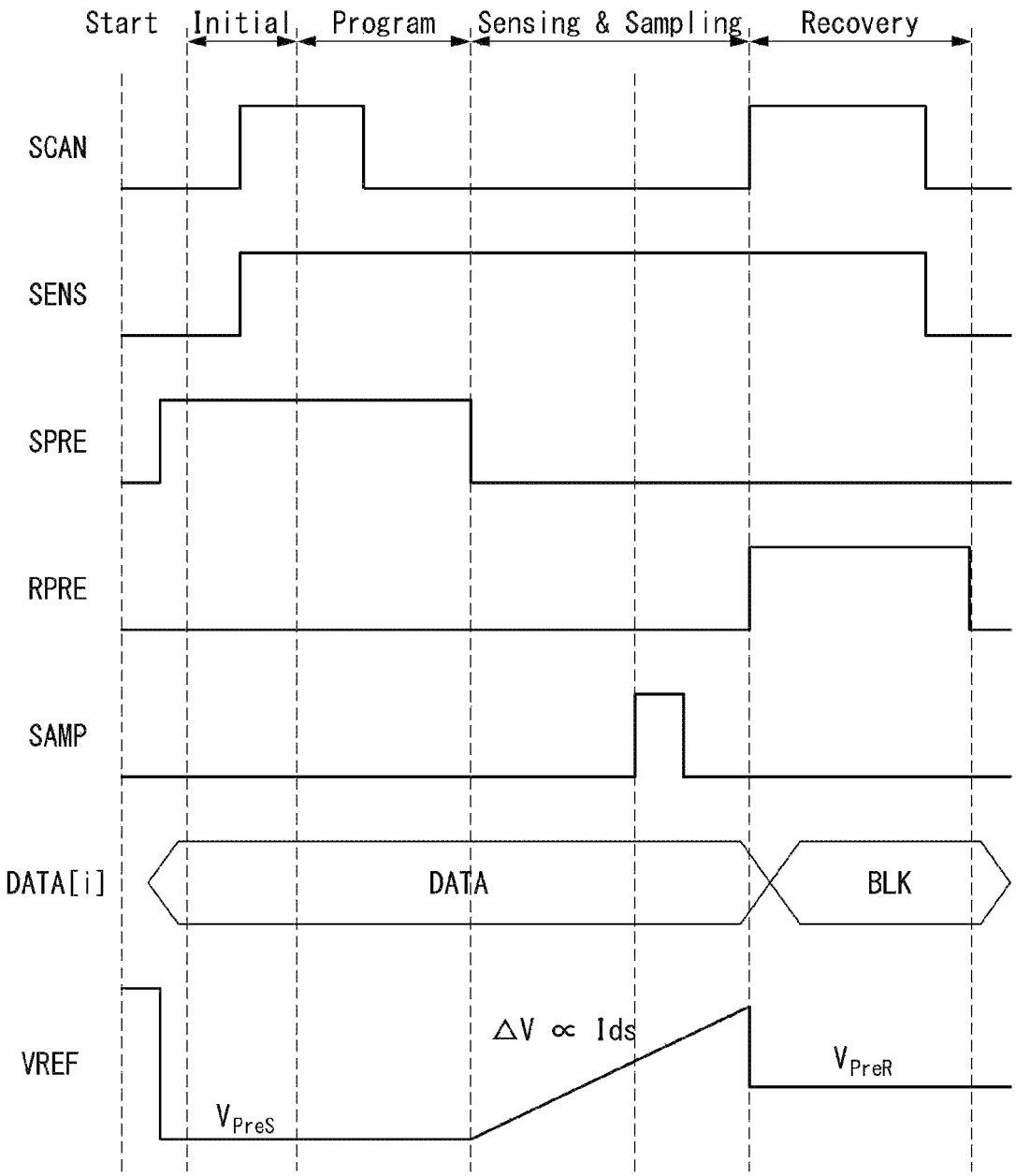

FIG. 1 is a schematic block diagram of a light emitting display device, FIG. 2 is a schematic circuit diagram of a subpixel, FIG. 3 is a diagram illustrating a specific circuit diagram of a subpixel, FIG. 4 is a cross-sectional view of a display panel, FIG. 5 is a plan view of a subpixel, FIG. 6 is a schematic block diagram of a data driver including an external compensation circuit, and FIGS. 7 and 8 are compensation waveform views for an external compensation operation.

As illustrated in FIG. 1, the light emitting display device includes an image processor 110, a timing controller 120, a scan driver 130, a data driver 140, a power supply unit 180, and a display panel 150.

The image processor 110 outputs a data enable signal DE together with a data signal DATA supplied from the outside. These data signal DATA supplied from the outside can be received from, for example, other electronic components, circuitry, or systems connected to the image processor 110. The image processor 110 may output at least one of a vertical synchronization signal, a horizontal synchronization signal, and a clock signal in addition to the data enable signal DE, but these signals are omitted for convenience of explanation.

The timing controller 120 is supplied with the data signal DATA in addition to driving signals including the data enable signal DE, the vertical synchronization signal, the horizontal synchronization signal, and the clock signal from the image processor 110. The timing controller 120 outputs a gate timing control signal GDC for controlling an operation timing of the scan driver 130 and a data timing control signal DDC for controlling an operation timing of the data driver 140.

In response to the data timing control signal DDC supplied from the timing controller 120, the data driver 140 samples and latches the data signal DATA supplied from the timing controller 120, converts the same into a data voltage on the basis of a gamma reference voltage, and subsequently outputs the converted data voltage. The data driver 140 outputs a data voltage through the data lines DL1 to DLn. The data driver 140 may be implemented using an integrated circuit (IC).

The scan driver 130 outputs a scan signal in response to the gate timing control signal GDC supplied from the timing controller 120. The scan driver 130 outputs a scan signal having a scan high voltage (e.g., a logic high signal) and a scan low voltage (e.g., a logic low signal) through the scan lines GL1 to GLm. The scan driver 130 is implemented using an IC and may be further implemented in a gate-in-panel (GIP) manner on the display panel 150.

The power supply circuit 180 (which may be referred to herein as a power supply unit 180) is connected to a first power line EVDD and a second power line EVSS connected to the display panel 150. The power supply unit 180 outputs a first potential power (high potential voltage) and a second potential power (low potential voltage) through the first power line EVDD and the second power line EVSS. The first potential power (high potential voltage) and the second potential power (low potential voltage), which are transmitted through the first power line EVDD and the second power line EVSS, are supplied to the subpixels SP of the display panel 150.

The display panel 150 displays an image in response to the data voltage supplied from the data driver 140, the scan signal supplied from the scan driver 130, and the power supplied from the power supply unit 180. The display panel 150 includes the subpixels SP that operate to display an image.

In one embodiment, the subpixels SP include a red subpixel, a green subpixel, and a blue subpixel. In other embodiments, the subpixels SP include a white subpixel, a red subpixel, a green subpixel, and a blue subpixel. The subpixels SP may have one or more different emission areas depending on emission characteristics.

As illustrated in FIG. 2, one subpixel includes a switching transistor SW, a driving transistor DR, a capacitor Cst, a compensation circuit CC, and an organic light emitting diode OLED.

In response to the scan signal supplied through the first scan line GL1, the switching transistor SW performs a switching operation so that the data voltage supplied through the first data line DL1 is stored as a data voltage in the capacitor Cst. The driving transistor DR operates so that a driving current flows between the first power line EVDD and the second power line EVSS according to the data voltage stored in the capacitor Cst. The organic light emitting diode OLED operates to emit light according to the driving current formed by the driving transistor DR.

The compensation circuit CC is a circuit added in the subpixel to compensate for a threshold voltage of the driving transistor DR, or the like. The compensation circuit CC includes one or more transistors. A configuration of the compensation circuit CC varies according to the external compensation method is not limited to the examples described herein. One example of the present disclosure is described as follows.

As illustrated in FIG. 3, the compensation circuit CC includes a sensing transistor ST and a sensing line VREF (or a reference line). The sensing transistor ST is connected between a source node of the driving transistor DR and an anode electrode of the organic light emitting diode OLED (hereinafter referred to as a sensing node). The sensing transistor ST operates to supply an initialization voltage (or sensing voltage) transmitted through the sensing line VREF to the source node (or sensing node) of the driving transistor DR or sense a voltage or current of the source node of the driving transistor DR.

A first electrode of the switching transistor SW is connected to the first data line DL1 and a second electrode thereof is connected to the gate electrode of the driving transistor DR. A first electrode of the driving transistor DR is connected to the first power line EVDD and a second electrode thereof is connected to the anode electrode of the organic light emitting diode OLED. A first electrode of the capacitor Cst is connected to the gate electrode of the driving transistor DR and a second electrode thereof is connected to the anode electrode of the organic light emitting diode OLED. An anode electrode of the organic light emitting diode OLED is connected to the second electrode of the driving transistor DR and a cathode electrode thereof is connected to the second power line EVSS. A first electrode of the sensing transistor ST is connected to the sensing line VREF and a second electrode thereof is connected to the anode electrode of the organic light emitting diode OLED as a sensing node and the second electrode of the driving transistor DR.

In some cases, an operating time of the sensing transistor ST may be similar or substantially the same as that of the switching transistor SW according to various external compensation algorithms (or various configurations of the compensation circuit). In other cases, an operating time of the sensing transistor ST may be different from that of the switching transistor SW according to different external compensation algorithms. For example, the gate electrode of the switching transistor SW may be connected to a 1a-th scan line GL1*a*, and the gate electrode of the sensing transistor ST may be connected to a 1b-th scan line GL1*b*. In another example, the 1a-th scan line GL1*a* connected to the gate electrode of the switching transistor SW and the 1b-th scan line GL1*b* connected to the gate electrode of the sensing transistor ST may be connected in common so as to be shared.

The sensing line VREF may be connected to the data driver. In this case, the data driver may sense the sensing node of the subpixel in real time, during a non-display period of an image, or during an N frame (N is an integer of 1 or greater) and generate a sensing result. Meanwhile, the switching transistor SW and the sensing transistor ST may be turned on at the same time. In this case, a sensing operation through the sensing line VREF and a data output operation for outputting a data voltage are separated from each other on the basis of a time division method of the data driver.

In addition, a compensation target according to the sensing result may be a digital data signal, an analog data voltage, or a gamma signal or any other suitable signals within the display device that needs compensation to provide uniform display characteristics of the device. The compensation circuit for generating a compensation signal (such as a compensation voltage) on the basis of the sensing result may be included in the data driver or the timing controller, or implemented as a separate circuit.

A light blocking layer LS may be disposed below a channel region of the driving transistor DR, or below a channel region of the switching transistor SW and the sensing transistor ST, or below the channel region of the driving transistor DR. The light blocking layer LS may be used for blocking external light. In another example, the light blocking layer LS may be used as an electrode that may be connected to other electrodes or lines. Yet in another example, the light blocking layer LS may be utilized for forming or configuring a capacitor or the like.

Although FIG. 3 shows, for example, a subpixel having a 3T1C structure (a three transistor, one capacitor structure) including the switching transistor SW, the driving transistor DR, the capacitor Cst, the organic light emitting diode OLED, and the sensing transistor ST, the subpixel may also be configured to have a 3T2C, 4T2C, 5T1C, 6T2C, or various combinations of transistors and capacitors when implementing a compensation circuit CC.

As illustrated in FIG. 4, subpixels are formed on a display area AA of a first substrate (or TFT substrate) 150*a* on the basis of the circuit described above with reference to FIG. 3. The subpixels formed on the display area AA are sealed by a protective film (e.g., passivation film) or a protective substrate 150*b*. The display area AA is an area for displaying an image and area outside of the display area AA refers to a non-display area NA in which no image is displayed. The first substrate 150*a* may be formed of, for example, glass or plastic or a material having ductility, pliability.

The subpixels are arranged horizontally or vertically in the order of red (R), white (W), blue (B) and green (G) on the display area AA. Subpixels R, W, B and G constitute a single pixel P. However, the arrangement order of the subpixels may be variously changed according to emission materials, emission areas, the configurations (or structures) of the compensation circuit, and the like. Also, the subpixels R, B, and G may constitute a single pixel P.

As illustrated in FIGS. 4 and 5, first to fourth subpixels SPn1 to SPn4 each having an emission area EMA and a circuit area DRA are formed on the display area AA of the first substrate 150*a*. An OLED is formed in the emission area EMA and TFTs including switching and driving transistors are formed in the circuit area DRA. The elements formed in the emission area EMA and the circuit area DRA are formed through processes of depositing a plurality of metal layers and insulating layers or other suitable layers.

In the first to fourth subpixels SPn1 to SPn4, the OLED positioned in the emission area EMA emits light in response to operations of the switching and driving transistors positioned in the circuit area DRA. The area indicated as "WA" positioned between the first to fourth subpixels SPn1 to SPn4 is a line area in which power lines or data lines are arranged.

The first power line EVDD may be positioned on the left of the first subpixel SPn1, the sensing line VREF may be positioned on the right of the second subpixel SPn2, and first and second data lines DL1 and DL2 may be positioned between the first subpixel SPn1 and the second subpixel SPn2.

The sensing line VREF may be positioned on the left of the third subpixel SPn3, the first power line EVDD may be positioned on the right of the fourth subpixel SPn4, and third and fourth data lines DL3 and DL4 may be positioned between the third subpixel SPn3 and the fourth subpixel SPn4.

The first subpixel SPn1 may be electrically connected to the first power line EVDD positioned on the left thereof, the first data line DL1 positioned on the right thereof, and the sensing line VREF positioned on the right of the second subpixel SPn2. The second subpixel SPn2 may be electrically connected to the first power line EVDD positioned on the left of the first subpixel SPn1, the second data line DL2 positioned on the left thereof, and the sensing line VREF positioned on the right thereof.

The third subpixel SPn3 may be electrically connected to the sensing line VREF positioned on the left thereof, the third data line DL3 positioned on the right thereof, and the first power line EVDD positioned on the right of the fourth subpixel SPn4. The fourth subpixel SPn4 may be electrically connected to the sensing line VREF positioned on the left of the third subpixel SPn3, the fourth data line DL4 positioned on the left thereof, and the first power line EVDD positioned on the right thereof.

Although the first to fourth subpixels SPn1 to SPn4 may be connected to share (or may be connected in common to) the sensing line VREF positioned between the second subpixel SPn2 and the third subpixel SPn3, the present disclosure is not limited thereto. In addition, although only one scan line GL1 is shown, the present disclosure is not limited thereto.

In addition, although lines such as the first power line EVDD and the sensing line VREF and the electrodes constituting the TFTs are positioned on different layers, they are electrically connected to each other through a contact hole (via hole). The contact hole is formed through dry or wet etching process to expose portions of an electrode, a signal line, or a power line positioned therebelow.

As illustrated in FIG. 6, the data driver 140 includes a first circuit unit 140*a* (data output circuit) outputting a data voltage to the subpixel SP and a second circuit unit 140*b* (data sensing circuit) for sensing the subpixel SP to compensate for a data voltage (or data signal of the timing controller).

The first circuit unit 140*a* includes a digital-to-analog converter (DAC) 141 converting a digital data signal supplied from the timing controller into an analog data voltage VDATA and outputting the converted data voltage VDATA. An output terminal of the first circuit unit 140*a* is connected to the first data line DL1.

The second circuit unit 140*b* includes a voltage output circuit SW1, a sampling circuit SW2, an analog-to-digital converter (ADC) 143, and the like. The voltage output circuit SW1 operates in response to a charge control signal PRE. The sampling circuit SW2 operates in response to a sampling control signal SAMP.

The voltage output circuit SW1 serves to output a first initialization voltage generated by a voltage source VREFF to the first sensing line VREF1 and output a second initialization voltage generated by the voltage source VREFF through the first data line DL1. The first initialization voltage and the second initialization voltage generated by the voltage source VREFF are generated as voltages between a first potential power (high potential voltage) and a second potential power (low potential voltage) and generally set to a voltage close to the second potential power. However, the voltage may be set to a different level based on employing different circuit designs or different compensation methods.

The first initialization voltage and the second initialization voltage may be set to voltages which are similar to or the same as each other. The first initialization voltage may be set to a voltage similar to a ground level in order to be used for external compensation of the display panel and the second initialization voltage may be set to be higher than the initialization voltage in order to be used for normal driving of the display panel. The voltage output circuit SW1 may operates when it outputs the first initialization voltage and the second initialization voltage. Only the switch SW1 and the voltage source VREFF are shown as components of the voltage output circuit SW1, but the present disclosure is not limited thereto.

The sampling circuit SW2 serves to sense the subpixel SP through the first sensing line VREF1. The sampling circuit SW2 senses a threshold voltage of the OLED, a threshold voltage of the driving transistor DR, or mobility in a sampling manner and then delivers a sensing value to the ADC 143. The sampling circuit SW2 is simply shown as a switch SW2, but without being limited thereto, the sampling circuit SW2 may be realized as an active element or a passive element, or a combination of the active and passive elements.

The ADC 143 receives the sensing value from the sampling circuit SW2 and converts the analog voltage value into a digital voltage value. The ADC 143 outputs a sensing value converted into a digital signal and is provided to a digital system connected to the ADC 143. The sensing value output from the ADC 143 is supplied to a circuit required for generating a compensation value. For example, a threshold voltage of the driving transistor is detected during a period in which a black data voltage is applied (or during a turn-on period of the device), and when the threshold voltage is changed, a compensation value is generated so as to have a value before the change.

Hereinafter, an example of waveforms for sensing a threshold voltage of the driving transistor DR and the mobility will be described as an example of the external compensation operation. However, the waveforms described below are only examples for illustrating the sensing operation and the present disclosure is not limited thereto.

As illustrated in FIGS. 6 and 7, in order to sense a threshold voltage of the driving transistor DR, the compensation circuit performs an operation such as programming, sensing & sampling, and initialization.

The scan signal SCAN is a signal for controlling the switching transistor SW. The switching transistor SW is turned on when the scan signal SCAN has a logic high level and turned off when the scan signal SCAN has a logic low level. The scan signal SCAN maintains the logic high level during a period including the programming and sensing/sampling.

The charge control signal PRE (as illustrated in FIG. 6) includes a first and second charge control signals SPRE and RPRE (as illustrated in FIG. 7) which are signals for controlling the voltage output circuit SW1. When the first charge control signal SPRE has a logic high level, the voltage output circuit SW1 outputs a first initialization voltage, and when the second charge control signal RPRE has a logic high level, the voltage output circuit SW1 outputs a second initialization voltage. The first charge control signal SPRE maintains the logic high level during the programming period. The second charge control signal RPRE maintains the logic high level during the initialization period.

The sampling control signal SAMP is a signal for controlling the sampling circuit SW2. The sampling circuit SW2 performs sampling for a sensing operation when the sampling control signal SAMP has a logic high level, and stops the sensing operation when the sampling control signal SAMP has a logic low level. The sampling control signal SAMP temporarily maintains the logic high level at the end of the sensing/sampling period.

The data driver 140 outputs the data voltages DATA and Vdata during the programming, sensing and sampling periods and outputs the black data voltage BLK during the initialization period.

According to the above operation, a voltage that may sense a threshold voltage of the driving transistor DR exists in the sensing line VREF. The sampling circuit SW2 senses a voltage present in the sensing line VREF during a sensing/sampling period.

As illustrated in FIGS. 6 and 8, in order to sense mobility of the driving transistor DR, the compensation circuit may perform an operation such as initialization, programming, sensing/sampling and recovery.

The scan signal SCAN is a signal for controlling the switching transistor SW. The switching transistor SW is turned on when the scan signal SCAN has a logic high level, and turned off when the scan signal SCAN has a logic low level. The scan signal SCAN maintains logic high during some period during the period including initialization and programming. In addition, the scan signal SCAN maintains logic high during some period during the recovery period.

The sensing signal SENS is a signal for controlling the sensing transistor ST. The sensing transistor ST is turned on when the sensing signal SENS has the logic high level, and turned off when the sensing signal SENS has the logic low level. The sensing signal SENS maintains the logic high state some period during the period including initialization, programming, sensing/sampling, and recovery.

The charge control signal PRE (as illustrated in FIG. 6) includes a first and second charge control signals SPRE and RPRE (as illustrated in FIG. 8) which are signals for controlling the voltage output circuit SW1. The voltage output circuit SW1 outputs a first initialization voltage when the first charge control signal SPRE has a logic high level, and outputs a second initialization voltage when the second charge control signal RPRE has a logic high level. The first charge control signal SPRE maintains the logic high state during the period including initialization and programming. The second charge control signal RPRE maintains the logic high state during the recovery period.

The sampling control signal SAMP is a signal for controlling the sampling circuit SW2. The sampling circuit SW2 performs sampling for a sensing operation when the sampling control signal SAMP has a logic high level, and stops the sensing operation when the sampling control signal SAMP has a logic low level. In one example, the sampling control signal SAMP temporarily maintains the logic high state during a certain period within the sensing/sampling period. In another example, the sampling control signal SAMP may temporarily maintain the logic high state towards the end of the sensing/sampling period.

The data driver 140 outputs the data voltage DATA during the initialization, programming and sensing/sampling period and outputs the black data voltage BLK during the recovery period.

Through the above operation, a current ($\Delta V \propto Ids$) capable of sensing mobility of the driving transistor DR is present in the sensing line VREF. The sampling circuit SW2 senses the current present in the sensing line VREF during the sensing/sampling period. For example, the voltage difference $\Delta V$ over a certain time period $\Delta t$ (e.g., sensing and sampling period shown in FIG. 8) which can be represented as a slope or a rate is proportionate to the driving current Ids. The electron mobility of the driving transistor DR can be sensed using the driving current Ids or the voltage difference $\Delta V$ or the combination of both.

Figure 9:
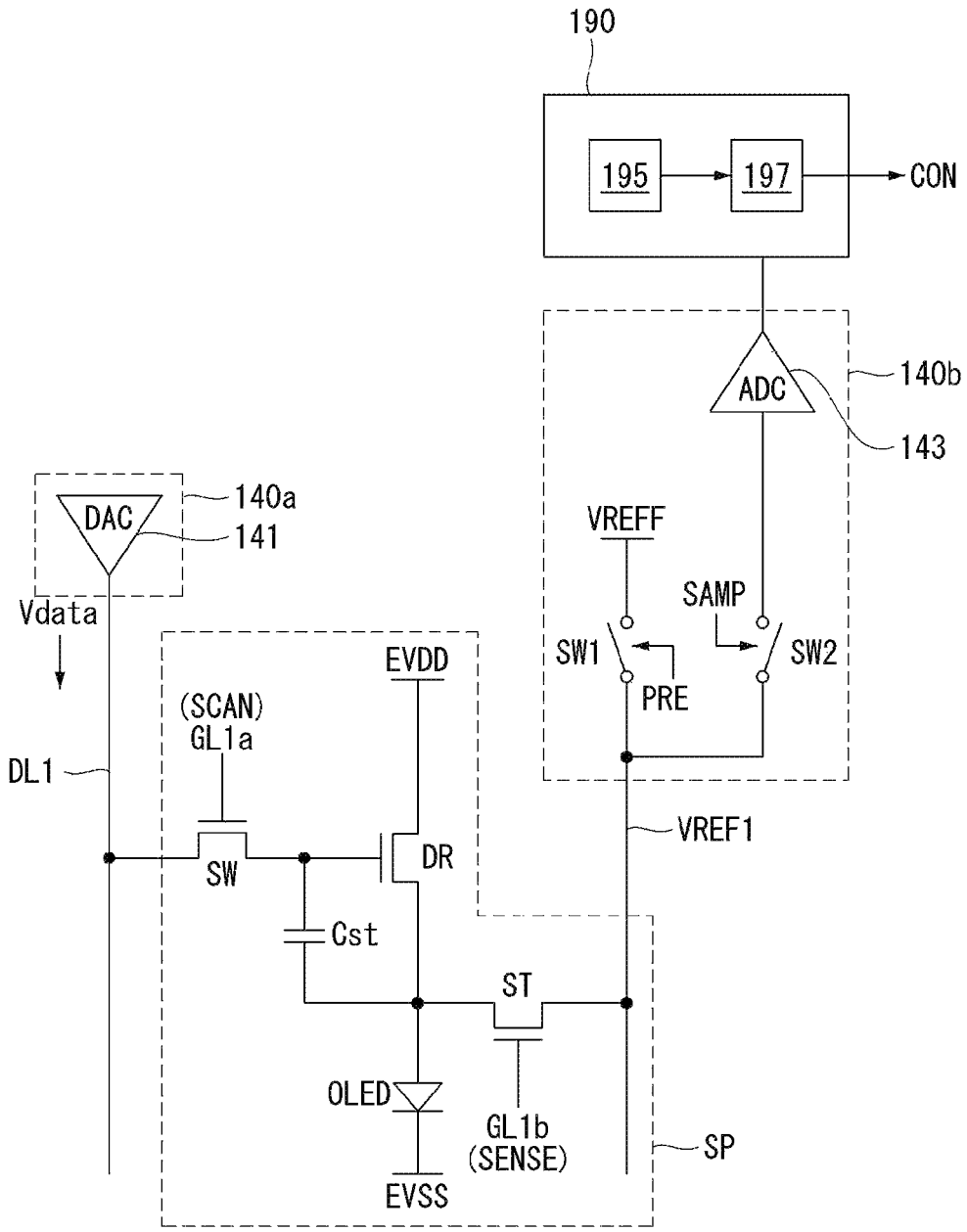
FIG. 9 is a block diagram schematically illustrating a data driver and a short detecting unit according to an embodiment.
Figure 10:
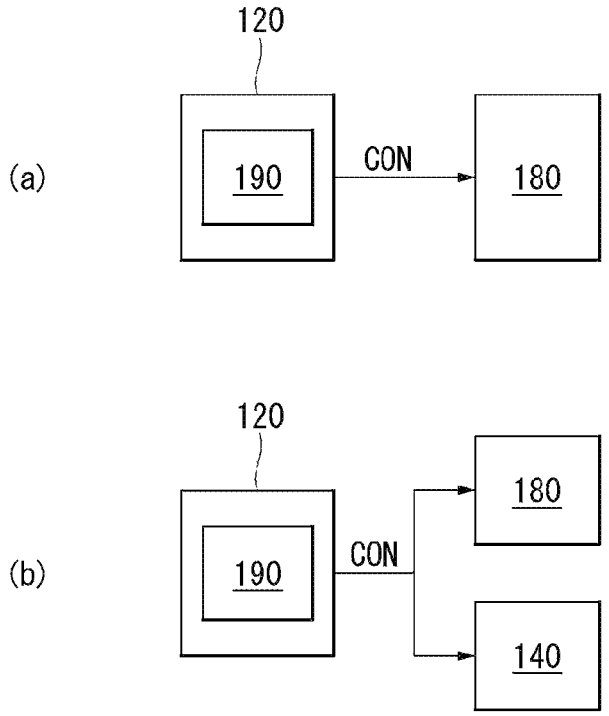
FIG. 10 is a block diagram schematically illustrating a timing controller having a short detecting unit and a device associated therewith.
Figure 11:
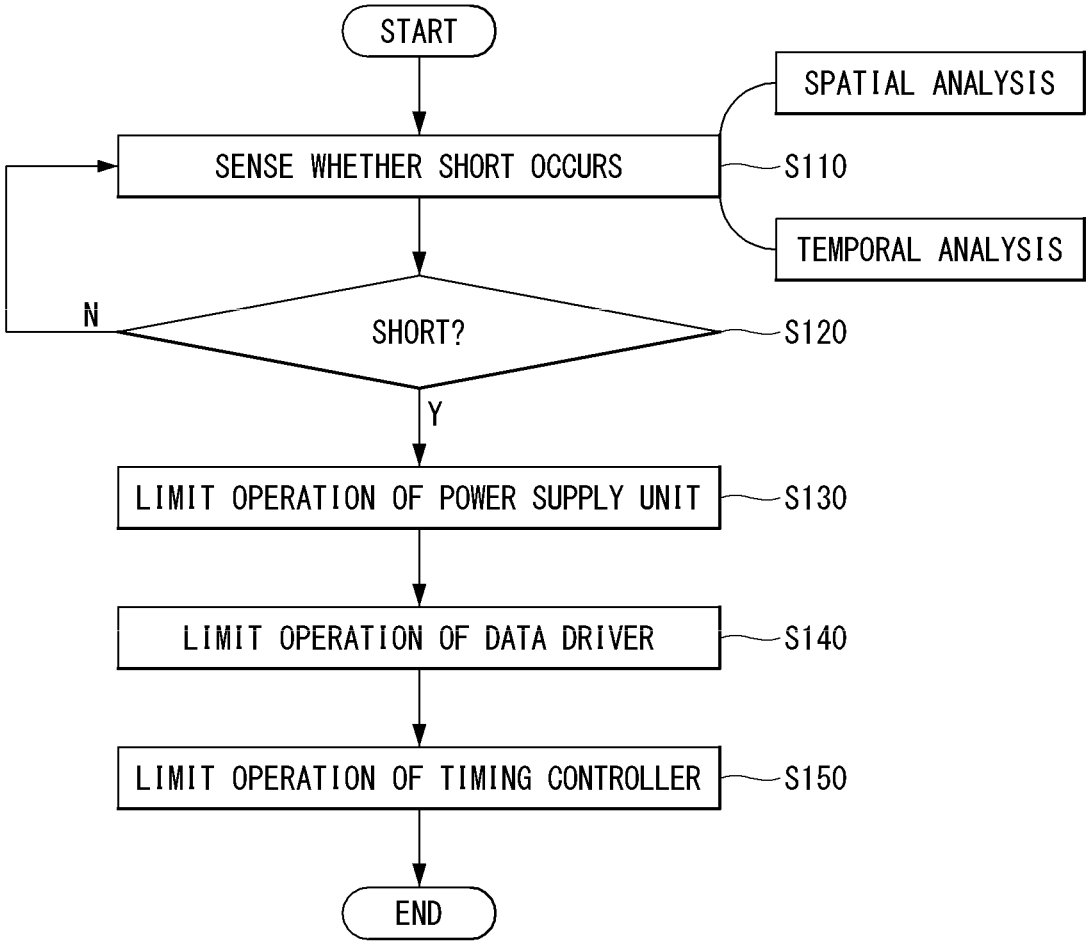
FIG. 11 is a flowchart illustrating burnt detect and protect (BDP) which may be performed on the basis of a short detecting unit according to an embodiment.

FIG. 9 is a block diagram schematically illustrating a data driver and a short detecting unit according to an embodiment, FIG. 10 is a block diagram schematically illustrating a timing controller having a short detecting unit and a device associated therewith, and FIG. 11 is a flowchart illustrating burnt detect and protect (BDP) which may be performed on the basis of a short detecting unit according to an embodiment.

As illustrated in FIG. 9, the short detecting circuit 190 (which may be referred to herein as a short detecting unit 190) according to an embodiment may be electrically connected to the data drivers 140*a* and 140*b* and interwork therewith. The short detecting unit 190 includes a determination circuit 195 (which may be referred to herein as a determination unit 195) and a signal output circuit 197 (which may be referred to herein as a signal output unit 197). The short detecting circuit 190, the determination circuit 195, and the signal output circuit 197 may include any electrical circuitry, features, components or the like configured to perform the various operations of the short detecting circuit 190, the determination circuit 195, and the signal output circuit 197 as described herein. In some embodiments, one or more of the short detecting circuit 190, the determination circuit 195, and the signal output circuit 197 may be included in or otherwise implemented by processing circuitry such as a microprocessor, microcontroller, or the like. The determination unit 195 analyzes a sensing value output from the second circuit unit 140*b* and determines whether there is a short or a burnt between the structures on the display panel (hereinafter, description will be made based on the short prior to the occurrence of the burnt). The signal output unit 197 outputs a control signal CON for controlling the power supply unit on the basis of a determination result of the determination unit 195. In one or more embodiments, the short between the structures within the display panel indicates forming a short circuit between structures, circuitries, or electronic components within the display device to cause an excessive amount of current flowing in those circuits. This excessive current flow may result in over-heating or burning of the aforementioned structures, circuitries, or electronic components within the display device.

As illustrated in (a) of FIG. 10, the short detecting unit 190 according to an embodiment may be included in the timing controller 120. The timing controller 120 having the short detecting unit 190 may output the control signal CON for controlling an operation (or output) of the power supply unit 180 when it is determined that there is a short between the structures on the display panel.

As illustrated in (b) of FIG. 10, the short detecting unit 190 according to an embodiment may be included in the timing controller 120. The timing controller 120 having the short detecting unit 190 may output the control signal CON for controlling the operation (or output) of the power supply unit 180 and the data driver 140 when it is determined that there is a short between the structures on the display panel.

As illustrated in FIGS. 9 and 11, the short detecting unit 190 performs spatial analysis and temporal analysis for determining whether there is a short or not and finally determines whether there is a short or a burnt in steps (S110 and S120) for sensing whether there is a short and determining whether there is a short.

In the spatial analyzing step, a cumulative sum of the sensing values for each channel is calculated, an average value of the cumulative sums is calculated, and the absolute value of |cumulative sum-average value| may be calculated (the symbol |x| indicates an absolute value of x). In the temporal analyzing step, if the calculated |cumulative sum-average value| does not deviate from a first threshold value (N), it is determined to be normal and the sensing whether there is a short may be continued. However, if the calculated |cumulative sum-average value| difference value deviates from the first threshold value, the number of counting is increased from a position of the corresponding channel, and thereafter, the increased number of counting is compared with a second threshold value. If there is multiple burnts beyond the short, it may be determined that a short or burnt has occurred in order to prevent spreading of the short or burnt.

If a short occurs (Y), the short detecting unit 190 may first activate BDP that may limit (block) the operation of the power supply unit 180 (S130). Thereafter, the short detecting unit 190 may limit (block) the operation of the data driver 140 (S140). Thereafter, the short detecting unit 190 may limit (block) the operation of the timing controller 120 (S150). As such, the short detecting unit 190 may preferentially control a device having a high probability of a fire (possibility of fire propagation) such as a burnt when a short occurs, but the present disclosure is not limited thereto, and the short detecting unit 190 may simultaneously control operations of all the devices.

Figure 12:
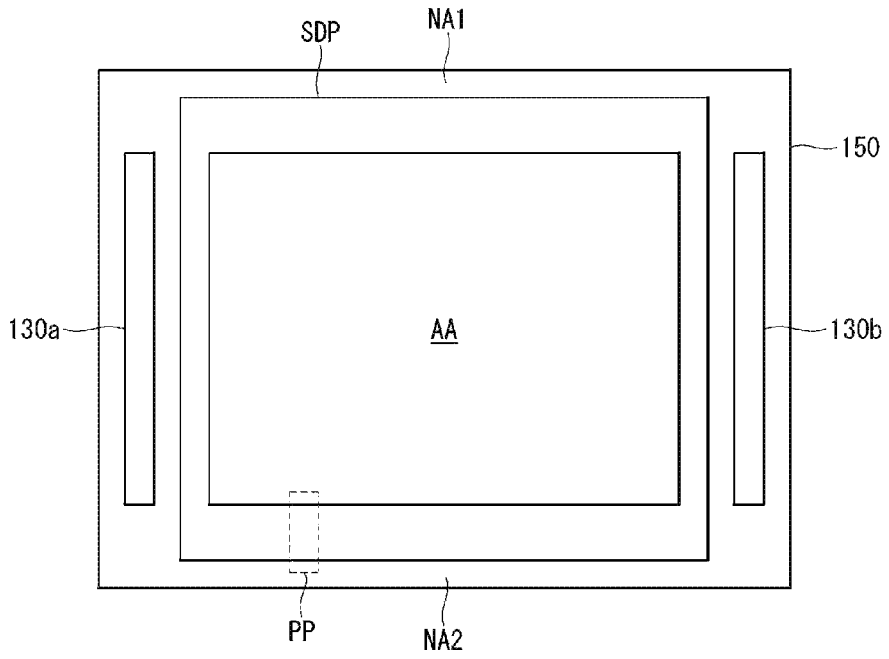
FIGS. 12 and 13 are exemplary layouts of a structure for short detection according to an embodiment.
Figure 13:
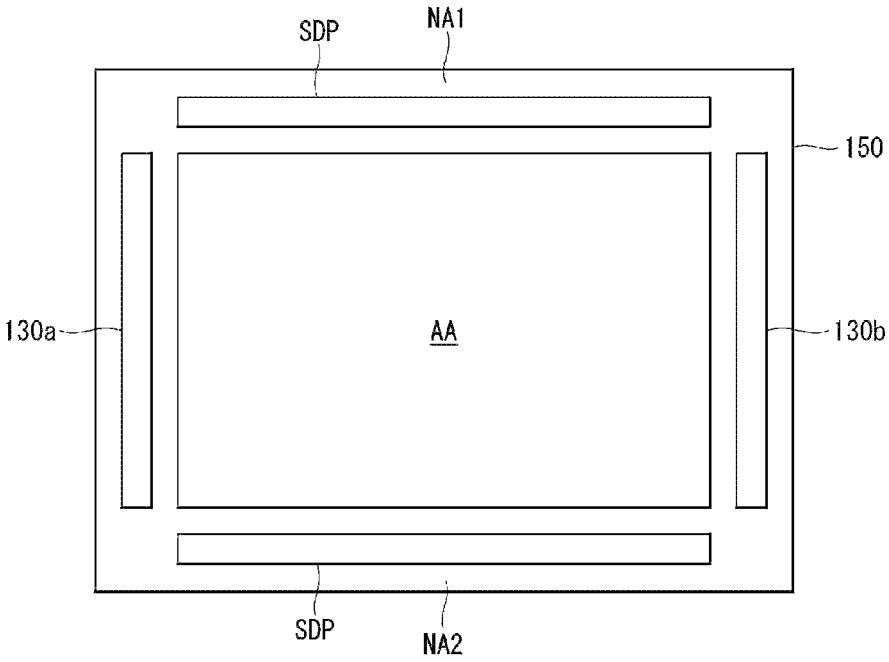
Figure 14:
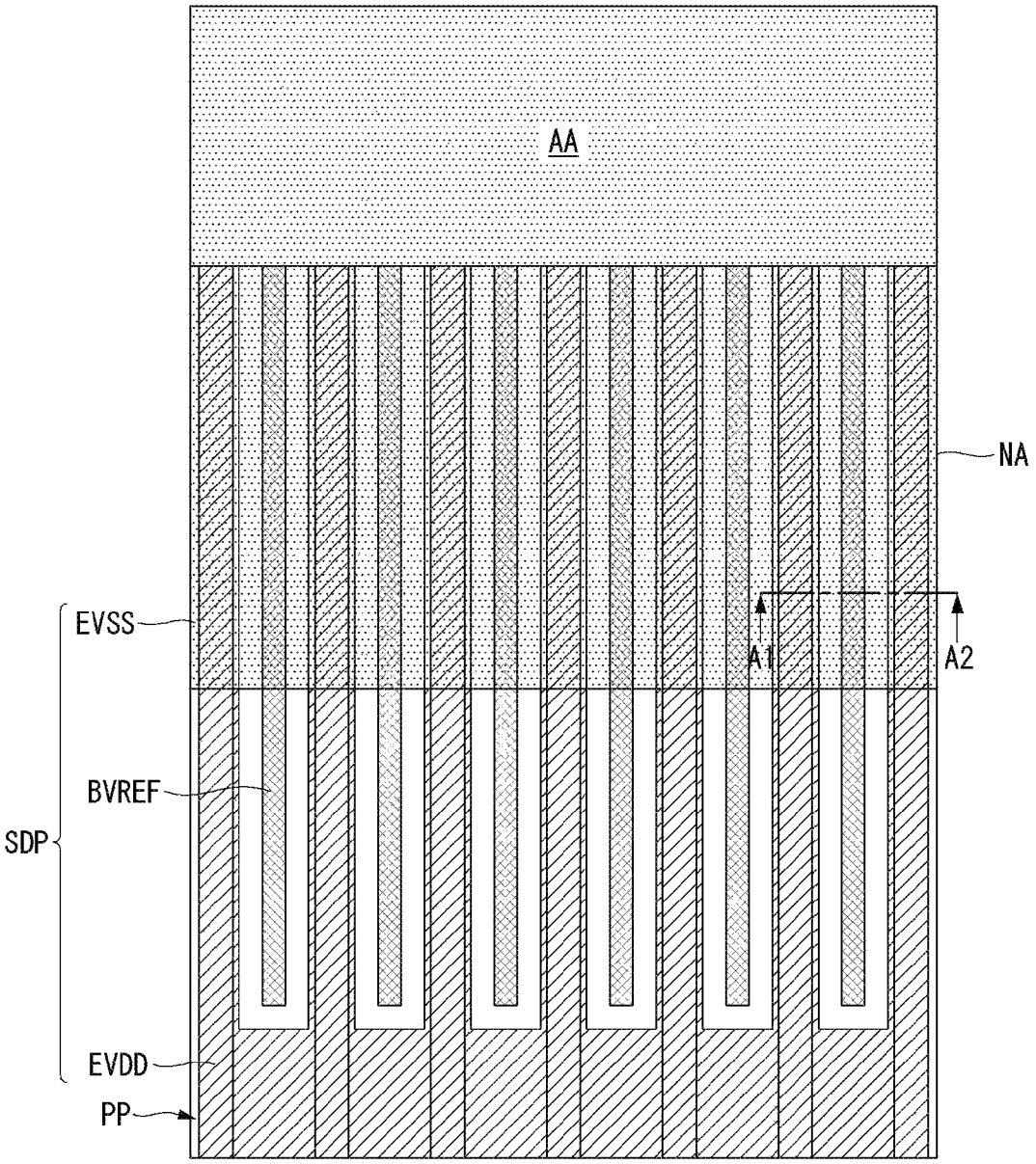
FIG. 14 is an enlarged view of a region of PP of FIG. 12.
Figure 15:
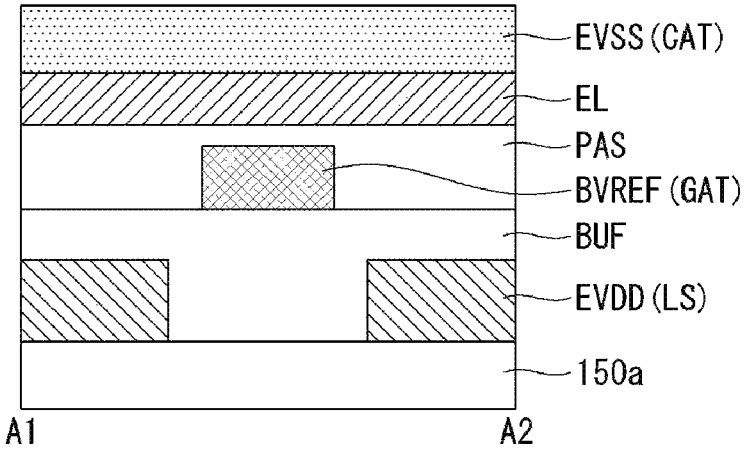
FIGS. 15 and 16 are cross-sectional taken along line A1-A2 of FIG. 14.
Figure 16:
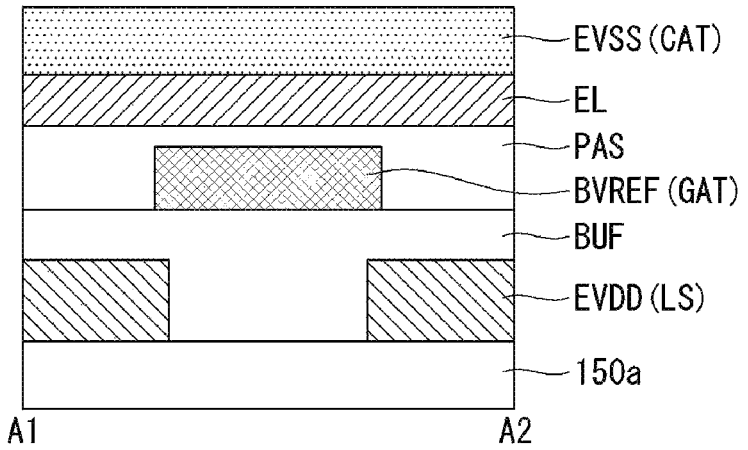
Figure 17:
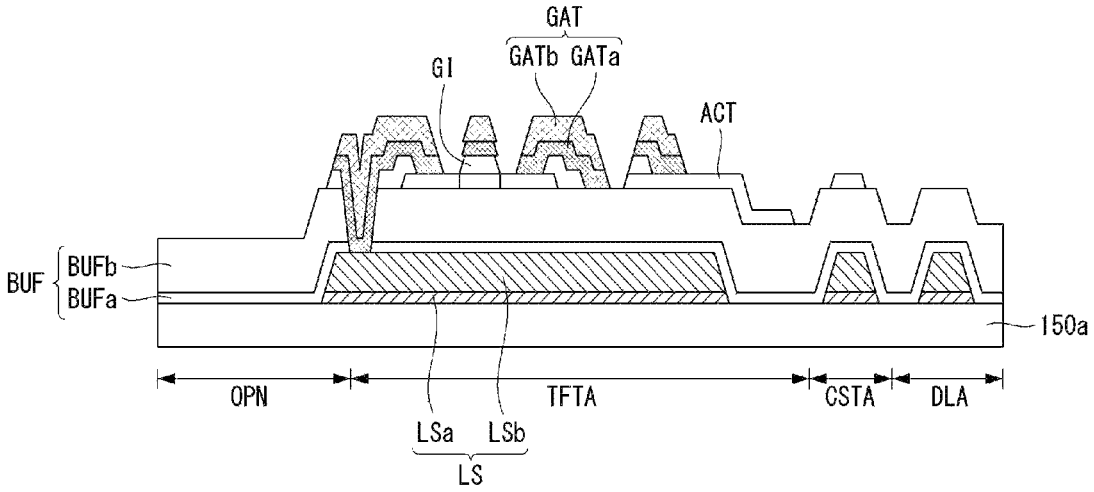
FIG. 17 is a cross-sectional view illustrating a lower structure disposed in a display area.

FIGS. 12 and 13 are exemplary layouts of a structure for short detection according to an embodiment, FIG. 14 is an enlarged view of a region of PP of FIG. 12, FIGS. 15 and 16 are cross-sectional taken along line A1-A2 of FIG. 14, and FIG. 17 is a cross-sectional view illustrating a lower structure disposed in a display area.

As illustrated in FIG. 12, the structure for short detection (also referred to as a short detection structure) SDP may be disposed in the non-display areas NA 1 and NA 2 along with the display area AA of the display panel 150. The first and second scan driver 130*a* and 130*b* are arranged in the left and right non-display areas with respect to the display area AA of the display panel 150. Therefore, although it is illustrated that the structure for short detection SDP is disposed in the upper and lower non-display areas NA1 and NA2 excluding the areas where the first and second scan drivers 130*a* and 130*b* are arranged, the present disclosure is not limited thereto and the structure for short detection SDP may be disposed in all the non-display areas.

As illustrated in FIG. 13, the structure for short detection SDP may be arranged only in the upper and lower non-display areas NA1 and NA2 or in the non-display area including the left and right sides, unlike the example of FIG. 12 described above. However, this is merely an example and the structure for short detection SDP may be arranged at appropriate locations in consideration of the structures arranged on the display panel and a location with a high possibility of a short.

As illustrated in FIGS. 14 to 16, the structure for short detection SDP positioned on the non-display area NA includes a first power line EVDD, a second power line EVSS, and a sensing line BVREF for short detection disposed therebetween. Thin films are deposited on the first substrate 150*a* in order of a light blocking layer LS, a buffer layer BUF, a gate metal layer GAT, a protective layer PAS, an emission layer EL, and a cathode electrode layer CAT.

FIG. 14 shows an area "PP" enlarging one side (corresponding to the upper side or the lower side) of the display area AA illustrated in FIG. 12. The same form may be implemented on the other side opposite to the one side but is not limited thereto. Meanwhile, as can be seen from the foregoing description, the structure for short detection SDP is formed also in the display area AA, as well as in the non-display area NA. In the case of the structure for short detection SDP positioned in the display area AA, although there may be a slight difference from the non-display area NA in a stacking structure, the basic structure and function thereof are the same. The structure for short detection SDP positioned on the non-display area NA is formed on the basis of the thin films formed on the first substrate 150*a*, and this will now be described in detail as follows.

The first power line EVDD is positioned on the first substrate 150*a*. The first power line EVDD is positioned on the first substrate 150*a* as with the light blocking layer LS and is formed of the same material as the light blocking layer LS. The first power line EVDD has a first portion having a shape of a surface electrode and a second portion divided into a plurality of portions spaced apart from each other at a predetermined interval. The first portion having the shape of a surface electrode is present adjacent to a portion near an outer end of the display panel and a portion near the display area AA and the plurality of second portions are present between the portion near the outer end of the display panel and the portion near the display area AA. The plurality of second portions have the same line width and spacing as the portions arranged in the display area AA. The interval of the plurality of second portions may be selected based on multiple factors. The intervals may be selected based on considering the multiple line arrangements and space within the display panel, the overall size of the display panel, various circuit design or configurations, or the like. The first portion having the shape of a surface electrode is for preventing IR drop of the first power line EVDD and has an area larger than the first power line EVDD disposed in the display area AA. The first power line EVDD is also generally called a shorting bar.

The sensing line BVREF for short detection is positioned on a buffer layer BUF covering the first power line EVDD. The sensing line BVREF for short detection may also be referred to as a short detection line for brevity. The sensing line BVREF for short detection is positioned on the buffer layer BUF as with the gate metal layer GAT and is formed of the same material as the gate metal layer GAT. The sensing line BVREF for short detection is divided into a plurality of portions. The sensing line BVREF for short detection is a portion extending from the display area AA and connected to the non-display area NA. Therefore, the sensing line BVREF for short detection simply additionally have the expression "for short detection" for distinguishing between the names and is substantially connected to the subpixels in the display area AA, and both a function and a role of the sensing line BVREF for short detection are the same as the sensing line. However, as previously described, the sensing line BVREF "for short detection" may also be referred to as a short detection line.

As can be seen from a comparison between FIGS. 15 and 16, the sensing line BVREF for short detection on the non-display area NA may be disposed to have a width narrower than a spacing between the first power lines EVDD spaced apart from each other (FIG. 15) or may be disposed to correspond to the spacing (FIG. 16). Since the sensing line BVREF for short detection extends from the display area, it is not necessary to adjust the width of the line. However, FIGS. 15 and 16 show an example that the line width of the sensing line BVREF for short detection may be changed in order to facilitate detection of damage due to an impact or a short due to a foreign object or to consider a possibility of occurrence of a parasitic capacitor.

As illustrated in FIG. 17, the display area AA (or a subpixel region) on the first substrate 150*a* includes an opening region OPN, a transistor region TFTA, a capacitor region CSTA, a data line region DLA, and the like. The opening region OPN is a region through which light of an emission layer exits, the transistor region TFTA is a region in which a switching transistor and a driving transistor are formed, the capacitor region CSTA is a region in which a capacitor is formed, and the data line region DLA is a region in which a data line is formed.

Thin films are formed on the first substrate 150*a* in order of a light blocking layer LS, a buffer layer BUF, an active layer (or semiconductor layer) ACT, a gate insulating layer GI, a gate metal layer GAT, and the like. Thin films such as a protective layer, a color filter layer (if necessary), an overcoat layer, and an anode electrode layer are formed on the gate metal layer GAT but, here, are omitted as they are not related to the characteristics of the present disclosure. That is, FIG. 17 is a view illustrating a comparison between a structure on the display area AA and a structure on the non-display area (NA) and illustrating that a specific layer is formed as a single layer or multiple layers, and as such, FIG. 17 is a schematic view thereof.

As can be seen from the comparison between FIG. 17, FIG. 15, and FIG. 16, the light blocking layer LS, the buffer layer BUF, the gate metal layer GAT positioned in the display area AA and the non-display area NA may be formed as a single layer or multiple layers. In case where the light blocking layer LS is formed as a dual layer, a first light blocking layer LSa and a second light blocking layer LSb may be formed of molybdenum (Mo) and copper (Cu) but are not limited thereto. When the buffer layer BUF is formed as multiple layers, a first buffer layer BUFa and a second buffer layer BUFb may be formed of silicon nitride (SiNx) and silicon oxide (SiOx) but are not limited thereto. When the gate metal layer GAT is formed as multiple layers, a first gate metal layer GATa and a second gate metal layer GATb may be formed of molytitanium (MoTi) and copper (Cu) but are not limited thereto.

Figure 18:
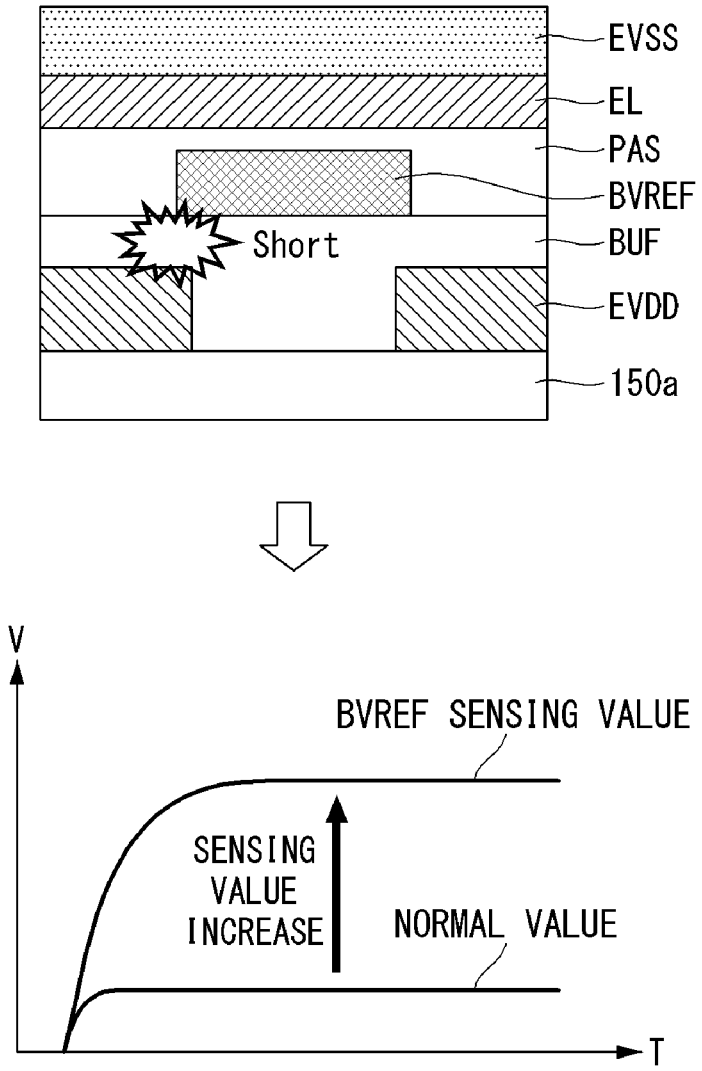
FIGS. 18 to 20 are views illustrating a difference in sensing value for each short case on the basis of a structure for short detection according to an embodiment.
Figure 19:
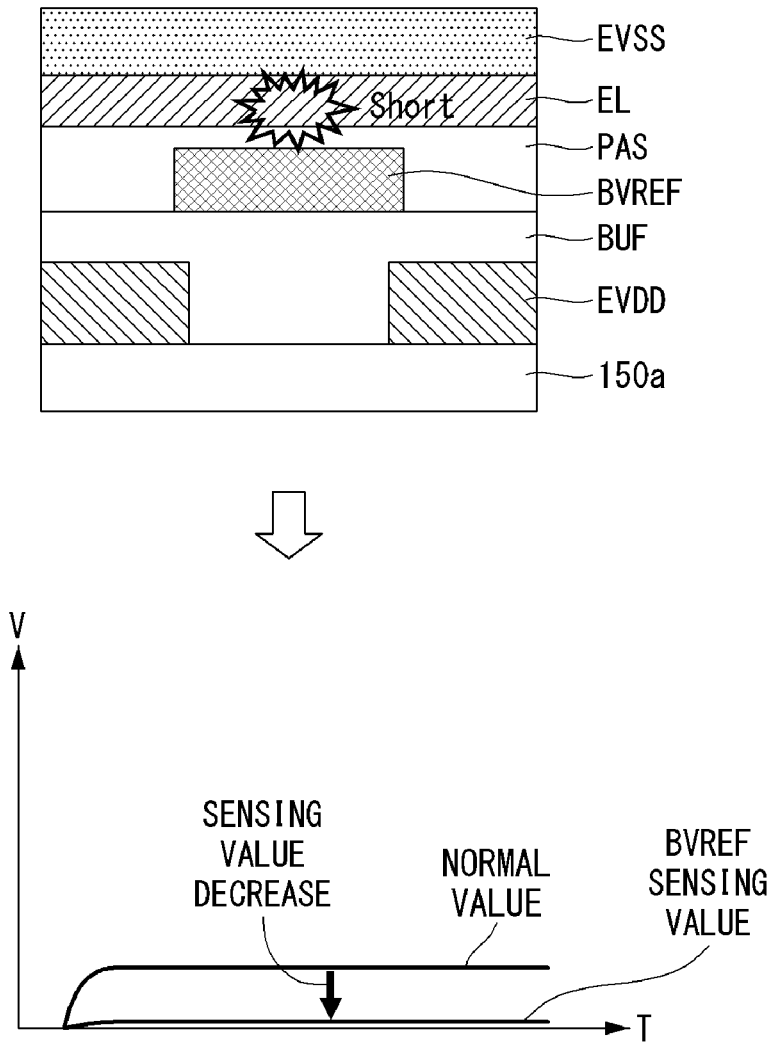
Figure 20:
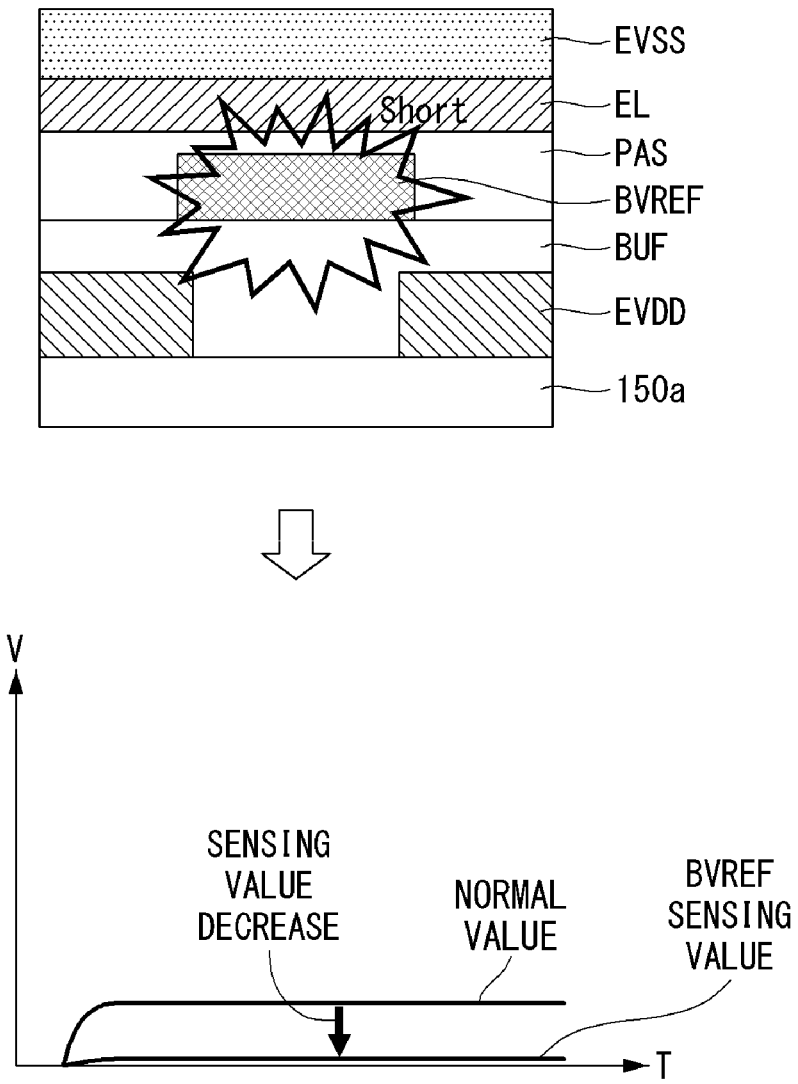

FIGS. 18 to 20 are diagrams illustrating a difference in sensing value of each short case based on the structure for short detection according to an embodiment.

FIG. 18 shows a case where a short occurs between the sensing line BVREF for short detection and the first power line (EVDD) due to an impact applied to a pad portion of the non-display area. If a short having such a form as illustrated in FIG. 18 occurs, a sensing value (BVREF sensing value) detected through the sensing line BVREF for short detection is detected to be higher than a normal value. The reason why the sensing value is detected higher than the normal value is because a first potential power applied through the first power line EVDD is detected substantially as is through the sensing line BVREF for short detection.

FIG. 19 shows a case where a short occurs between the sensing line BVREF for short detection and the second power line EVSS due to an impact applied to a pad portion of the non-display area. If a short having such a form as illustrated in FIG. 19 occurs, a sensing value (BVREF sensing value) detected through the sensing line BVREF for short detection is detected to be lower than the normal value. The reason why the sensing value is lower than the normal value is because the second potential power applied through the second power line EVSS is detected substantially as is through the sensing line BVREF for short detection.

FIG. 20 shows a case where a short occurs between the first power line EVDD, the sensing line BVREF for short detection, and the second power line EVSS due to an impact applied to the pad portion of the non-display area. If a short having such a form as illustrated in FIG. 20 occurs, a sensing value (BVREF sensed value) detected through the sensing line BVREF for short detection is detected to be lower than the normal value. The reason why the sensing value is lower than the normal value is because the second potential power applied through the second power line EVSS is detected substantially as is through the sensing line BVREF for short detection. For reference, the first potential power is discharged through the second potential power and thus is rarely detected.

The normal value mentioned in the descriptions of FIGS. 18, 19, and 20 may be defined as a reference value set internally as a level corresponding to an initialization voltage (or sensing voltage) charged in the sensing line. However, this is merely an example, and a separate voltage for short detection may be applied to determine and detect the presence or absence of a short. In such a case, it is preferable that the voltage for short detection has a level different from that of the first potential power or the second potential power.

Figure 21:
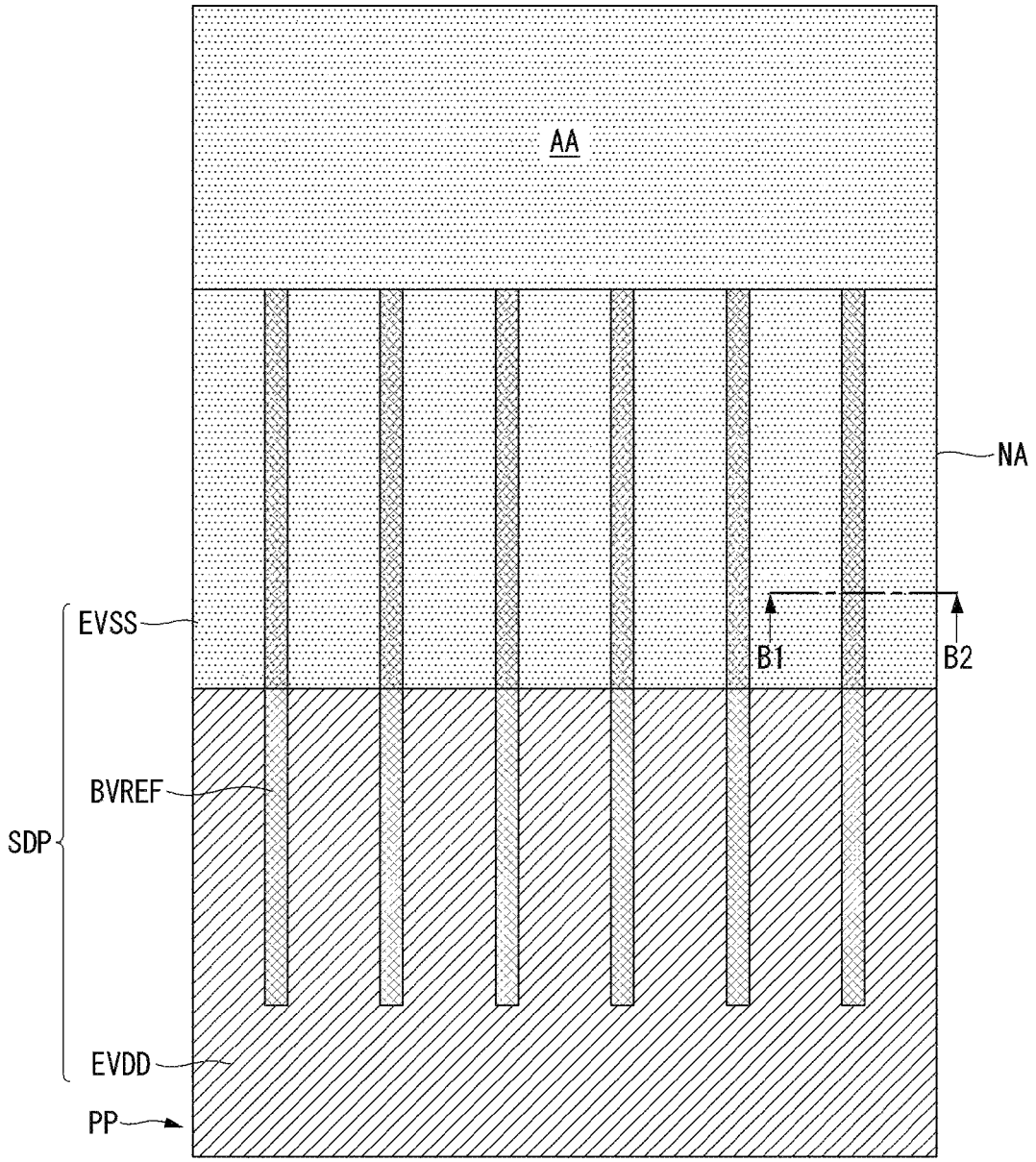
FIG. 21 is an enlarged view of the region of PP of FIG. 12 according to another embodiment.
Figure 22:
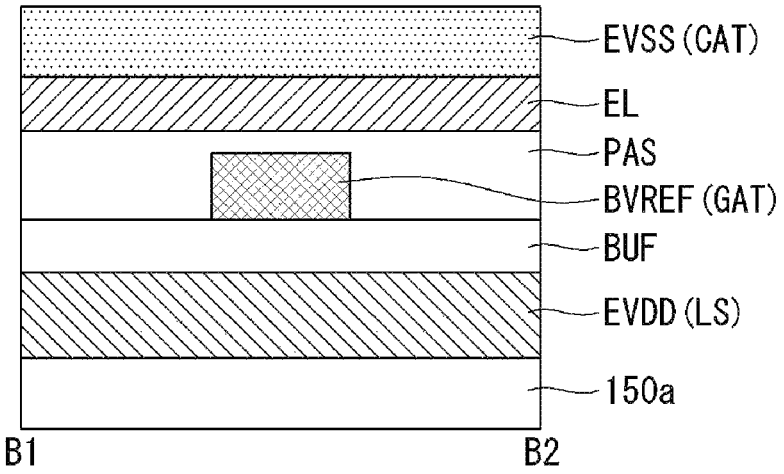
FIG. 22 is a cross-sectional view taken along line B1-B2 of FIG. 21.

FIG. 21 is an enlarged view illustrating a region PP of FIG. 12 according to another embodiment, and FIG. 22 is a cross-sectional view taken along line B1-B2 in FIG. 21.

As illustrated in FIGS. 21 and 22, the first power line EVDD is positioned on the first substrate 150*a*. The first power line EVDD is positioned on the first substrate 150*a* as with the light blocking layer LS and is formed of the same material as the light blocking layer LS. The first power line EVDD has a portion having a shape of a surface electrode and only a portion thereof positioned in the display area AA is divided into a plurality of portions. That is, only the portion of the first power line EVDD positioned in the non-display area NA has the shape of a surface electrode.

The sensing line BVREF for short detection is positioned on a buffer layer BUF covering the first power line EVDD. The sensing line BVREF for short detection is positioned on the buffer layer BUF as with the gate metal layer GAT and is formed of the same material as the gate metal layer GAT. The sensing line BVREF for short detection is divided into a plurality of portions. The sensing line BVREF for short detection is a portion extending from the display area AA and connected to the non-display area NA. Therefore, the sensing line BVREF for short detection simply additionally have the expression "for short detection" for distinguishing between the names and is substantially connected to the subpixels in the display area AA, and both a function and a role of the sensing line BVREF for short detection are the same as the sensing line.

In the structure for short detection SDP provided according to another embodiment, compared with the one embodiment, the first power line EVDD portion positioned in the non-display area NA is formed to be large to have a shape of a surface electrode. In case where the first power line (EVDD) portion positioned in the non-display area NA is formed to be large to have the shape of a surface electrode, the area for detecting the presence or absence of a short is increased, advantageously enhancing detection capability.

Figure 23:
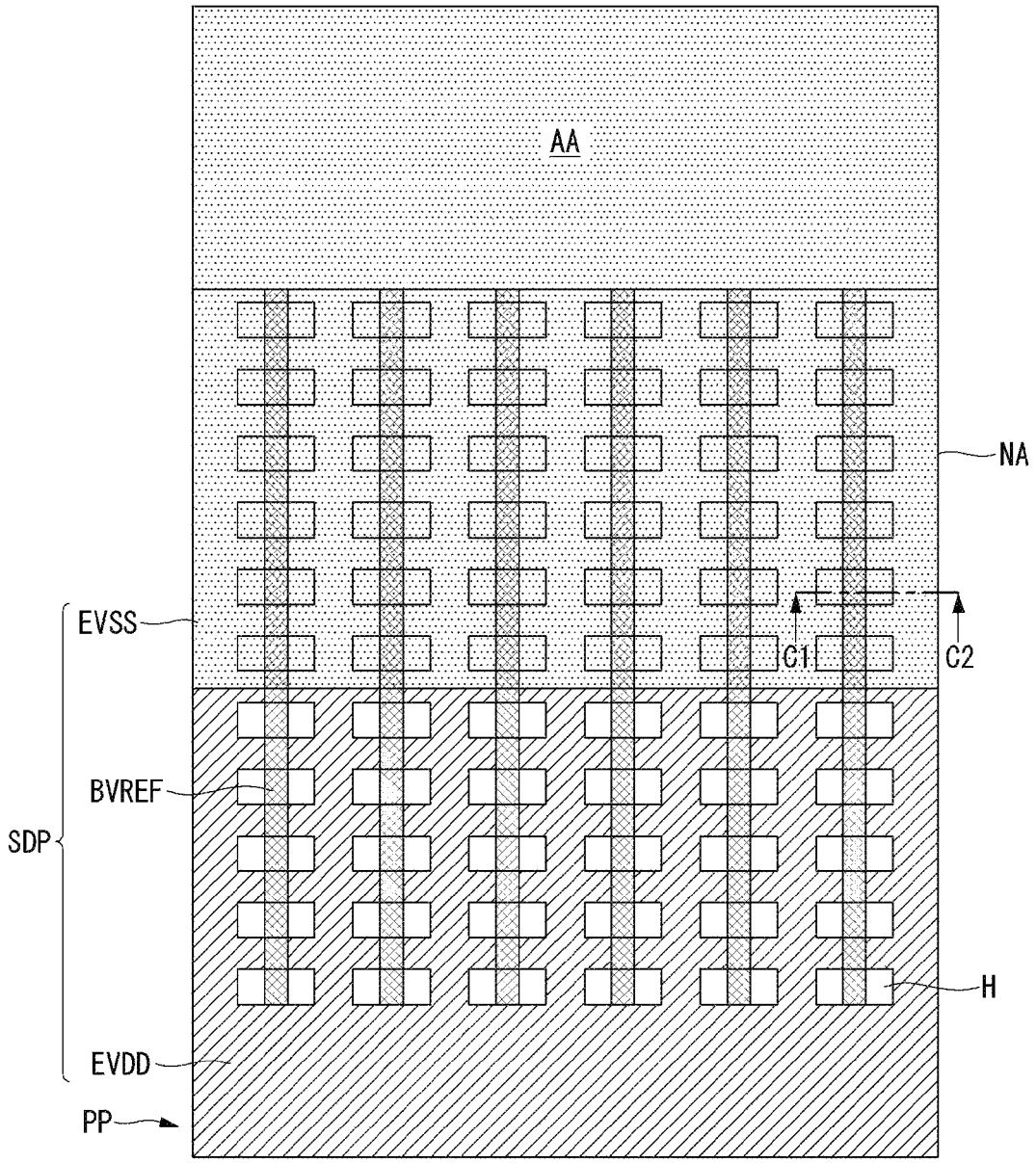
FIG. 23 is an enlarged view illustrating the region of PP of FIG. 12 according to another embodiment.
Figure 24:
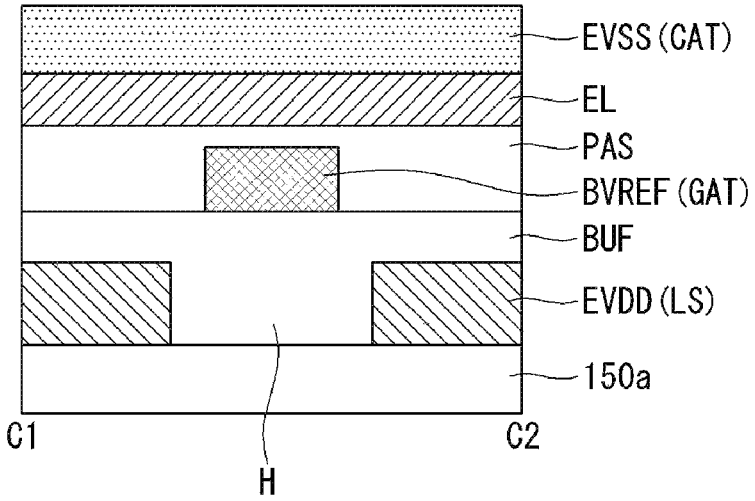
FIG. 24 is a cross-sectional view taken along line C1-C2 of FIG. 23.

FIG. 23 is an enlarged view illustrating a region "PP" of FIG. 12 according to yet another embodiment, and FIG. 24 is a cross-sectional view taken along line C1-C2 of FIG. 23.

As illustrated in FIGS. 23 and 24, the first power line EVDD is positioned on the first substrate 150*a*. The first power line EVDD is positioned on the first substrate 150*a* as with the light blocking layer LS and is formed of the same material as the light blocking layer LS. The first power line EVDD has a shape of a surface electrode and has a recess H exposing the surface of the first substrate 150*a*. Only a portion of the first power line EVDD positioned in the display area AA is divided into a plurality of portions. That is, only the portion of the first power line EVDD positioned in the non-display area NA has the shape of a surface electrode having the recess H. The recess H of the first power line EVDD is arranged in plurality and spaced apart from each other in a first direction (vertical direction in the drawing) in which the sensing line BVREF for short detection is disposed. That is, a portion of the first power line EVDD positioned in the non-display area NA has a plurality of recesses H arranged to correspond to the sensing line BVREF for short detection. A width of the recess H of the first power line EVDD is larger than a width of the sensing line BVREF for short detection.

The sensing line BVREF for short detection is positioned on a buffer layer BUF covering the first power line EVDD. The sensing line BVREF for short detection is positioned on the buffer layer BUF as with the gate metal layer GAT and is formed of the same material as the gate metal layer GAT. The sensing line BVREF for short detection is divided into a plurality of portions. The sensing line BVREF for short detection is a portion extending from the display area AA and connected to the non-display area NA. Therefore, the sensing line BVREF for short detection simply additionally have the expression "for short detection" for distinguishing between the names and is substantially connected to the subpixels in the display area AA, and both a function and a role of the sensing line BVREF for short detection are the same as the sensing line.

In the structure for short detection SDP provided according to yet another embodiment, compared with one embodiment and another embodiment, the first power line EVDD portion positioned in the non-display area NA has the plurality of recesses H and is formed to be large to have the shape of a surface electrode. As in another embodiment, when the first power line EVDD portion positioned in the non-display area NA has the plurality of recesses H and is formed large to have the shape of a surface electrode, an area for detecting the presence or absence of a short may be increased, advantageously enhancing detection capability. In addition, an overlapping area between the first power line EVDD and the sensing line BVREF for short detection may be reduced due to the plurality of recesses H, and thus, a possibility of generating a parasitic capacitor therebetween and a problem (sensing deviation, etc.) which may be caused thereby may be prevented.

In the above description, the embodiments have been described separately. However, one or more of the embodiments may be partially or entirely applied in consideration of the requirements such as the characteristics of the display panel, the sensing voltage, the sensing method, and the point where the possibility of short is high.

As described above, according to the present disclosure, when a defect such as a short or a burnt which may occur between structures constituting the display panel is detected, driving of the device is limited to prevent damage to the device or propagation of the damage, and further, a possibility of a fire may be prevented in advance. In addition, by detecting a defect such as a short or burnt of the display panel, damage (phenomenon that a polarizer, a cover substrate, etc., are melt by heat having high temperatures, etc.) to components formed inside or outside the device related to the display panel, as well as the device, may be prevented, and a risk such as a safety accident, or the like, that may be caused thereby may be prevented.

According to an example of the present disclosure, the structure for short detection is positioned in at least one of a display area displaying an image and a non-display area not displaying an image in the display panel.

According to an example of the present disclosure, the first power line is positioned on a first substrate constituting the display panel, the line for short detection (also referred to as a short detection line) is positioned on a buffer layer on the first power line, and the second power line is positioned on an insulating layer on the line for short detection.

According to an example of the present disclosure, the line for short detection is disposed to extend from a sensing line connected to a subpixel in the display area of the display panel to the non-display area of the display panel.

According to an example of the present disclosure, the first power line in the non-display area of the display panel has a first portion having a shape of a surface electrode and a second portion divided into a plurality of portions spaced apart from each other by a predetermined interval.

According to an example of the present disclosure, the first power line in the non-display area of the display panel has a shape of a surface electrode having an area larger than the first power line in the display area of the display panel.

According to an example of the present disclosure, the first power line in the non-display area of the display panel has a shape of a surface electrode and has a recess exposing a surface of the first substrate.

According to an example of the present disclosure, the recess of the first power line is provided in plurality and spaced apart from each other along a first direction in which the line for short detection is disposed.

According to an example of the present disclosure, the sensing value obtained by sensing the line for short detection is detected to be higher than a reference value, the short detecting unit determines a short between the first power line and the line for short detection, and when the sensing value obtained by sensing the line for short detection is detected to be lower than the reference value, the short detecting unit determines a short between two or more of the first power line, the line for short detection, and the second power line.

According to an example of the present disclosure, the first power line is formed based on the same material as a light blocking layer positioned on the first substrate.

According to an example of the present disclosure, a width of the recess of the first power line is larger than a width of the line for short detection.

According to an example of the present disclosure, the voltage for short detection has a level different from a first potential power applied through the first power line and a second potential power applied through the second power line.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A light emitting display device, comprising:

a display panel for displaying an image;

a short detection structure including a first power line, a second power line, and a short detection line disposed between the first power line and the second power line in the display panel; and a short detecting circuit sensing a sensing value from the short detection line and determining whether a short occurs at the display panel based on the sensing value, the first power line is positioned on a first substrate of the display panel, wherein the short detection line is positioned on a buffer layer on the first power line, and wherein the second power line is positioned on an insulating layer on the short detection line.

2. The light emitting display device of claim 1, wherein the short detection structure is positioned in at least one of a display area displaying the image data and a non-display area adjacent to the display area that is not displaying the image.

3. The light emitting display device of claim 1, wherein the short detection line extends from a sensing line connected to a subpixel in the display area of the display panel to the non-display area of the display panel.

4. The light emitting display device of claim 1, wherein the first power line in the non-display area of the display panel has a first portion and a plurality of second portions, each of the plurality of second portions extending toward the display area from the first portion, the second portions spaced apart from each other by a predetermined interval.

5. The light emitting display device of claim 1, wherein the first power line in the non-display area of the display panel has an area larger than the first power line in the display area of the display panel.

6. The light emitting display device of claim 1, wherein when the sensing value obtained by sensing the short detection line is detected to be higher than a reference value, the short detecting circuit determines a short between the first power line and the short detection line, and when the sensing value obtained by sensing the short detection line is detected to be lower than the reference value, the short detecting circuit determines a short between two or more of the first power line, the short detection line, and the second power line.

7. The light emitting display device of claim 1, wherein the first power line is formed of a same material as a light blocking layer on the first substrate.

8. The light emitting display device of claim 1, wherein the first power line in the non-display area of the display panel has a recess exposing a surface of the first substrate.

9. The light emitting display device of claim 8, wherein the recess of the first power line is provided in plurality and spaced apart from each other along a first direction in which the line for short detection is disposed.

10. The light emitting display device of claim 9, wherein a width of the recess of the first power line is larger than a width of the short detection line.

11. A method of driving a light emitting display device, the method comprising:

applying a voltage for short detection to a short detection line, the short detection line being between a first power line and a second power line;

sensing a sensing value from the short detection line; and determining whether a short occurs in the display device based on the sensing value, and wherein the short detection line is positioned on a buffer layer on the first power line, and wherein the second power line is positioned on an insulating layer on the short detection line.

12. The method of claim 11, wherein determining of whether a short occurs in the display panel includes:

determining a short between the first power line and the short detection line, when the sensing value obtained by sensing the short detection line is detected to be higher than a reference value; and determining a short between two or more of the first power line, the short detection line, and the second power line, when the sensing value obtained by sensing the short detection line is detected to be lower than the reference value.

13. The method of claim 11, wherein the voltage for short detection has a level different from a first potential power applied through the first power line and a second potential power applied through the second power line.

14. A method of driving a light emitting display device, the method comprising:

applying—a voltage for short detection to a short detection line, the short detection line between a first power line and a second power line;

sensing a sensing value from the short detection line;

determining whether a short occurs in the display device based on the sensing value, wherein the determining of whether a short occurs in the display device includes:

in response to determining that a short occurred in the display device, limiting an operation of a power supply circuit supplying power to the display device;

limiting an operation of a data driver supplying a data voltage to the display device; and limiting an operation of a timing controller controlling the data driver.

15. A light emitting display device, comprising:

a display panel having a plurality of structures;

a short detecting circuit connected to the display panel through a short detection line between a first power line and a second power line, and configured to sense a value from the display panel through the short detection line, the short detection line over the first power line and the second power line over the short detection line; and a determination circuit included in the short detecting circuit, the determination circuit configured to determine whether a short occurred between the plurality of structures at the display panel based on the value.

16. The light emitting display device of claim 15, further comprising a power supply circuit configured to provide power to the plurality of structures based on the determination of the determination circuit.

17. The light emitting display device of claim 16, wherein the short detecting circuit further includes a signal output circuit configured to output a control signal for controlling the power supply circuit based on the determination of the determination circuit.

* * * * *